US006405721B1

(12) United States Patent
Moren

(10) Patent No.: US 6,405,721 B1
(45) Date of Patent: Jun. 18, 2002

(54) CRANKCASE VENTILATION IN A SUPERCHARGED INTERNAL COMBUSTION ENGINE

(75) Inventor: Mats Moren, Göteborg (SE)

(73) Assignee: Volvo Personvagnar AB (SE)

( * ) Notice: Subject to any disclaimer, the term of this patent is extended or adjusted under 35 U.S.C. 154(b) by 0 days.

(21) Appl. No.: 09/682,686

(22) Filed: Oct. 5, 2001

Related U.S. Application Data

(63) Continuation of application No. PCT/SE00/00657, filed on Apr. 6, 2000.

(51) Int. Cl.[7] ..... F02M 25/06
(52) U.S. Cl. ..... 123/572; 123/557.1
(58) Field of Search ..... 123/572, 573, 123/574, 559.1

(56) References Cited

U.S. PATENT DOCUMENTS 3,754,538 A * 8/1973 Ephrain, Jr. et al. ..... 123/572
4,597,372 A 7/1986 Furukawa
4,901,703 A 2/1990 Humphries
4,962,745 A * 10/1990 Ohno et al. ..... 123/572
5,329,913 A * 7/1994 Suzuki et al. ..... 123/573
5,669,366 A * 9/1997 Beach et al. ..... 123/572

FOREIGN PATENT DOCUMENTS

JP 56-162217 12/1981

* cited by examiner

*Primary Examiner*—Marguerite McMahon
(74) *Attorney, Agent, or Firm*—Kilpatrick Stockton LLP

(57) ABSTRACT

A supercharged internal combustion engine with crankcase ventilation, comprising a first evacuation channel for evacuating blow-by gas from the engine crankcase to its intake channel downstream of the throttle, and a second evacuation channel for evacuating blow-by gas from the crankcase to the engine intake channel on the suction side of the compressor. Each evacuation channel is connected to an individual oil separator, a pressure regulator and a non-return valve. Each non-return valve permits free gas flow in the direction from the crankcase, but prevents or limits flow in the opposite direction.

12 Claims, 2 Drawing Sheets

CRANKCASE VENTILATION IN A SUPERCHARGED INTERNAL COMBUSTION ENGINE

CROSS REFERENCE TO RELATED APPLICATIONS

The present application is a continuation of International Application No. PCT/SE00/00657, filed Apr. 6, 2000, which claims priority to Swedish Application No. 9901250-2, filed Apr. 8, 1999.

BACKGROUND OF THE INVENTION

1. Technical Field

The present invention relates to crankcase ventilation systems. More specifically, the present invention relates to an air intake channel in communication with intake channels in the cylinder head of a supercharged internal combustion engine for preventing overpressure in a crankcase.

2. Background Information

In an internal combustion engine, it is difficult to provide piston ring seals between the pistons and their surrounding cylinder walls that provide a complete seal between the combustion chambers and the engine crankcase in normal engine operation, as opposed to engine braking. A certain amount of combustion gases, referred to as "blow-by", almost always leaks past the piston rings into the engine crankcase. To avoid excessively high overpressure developing in the crankcase due to blow-by, the crankcase must be ventilated, wherein these gases are diverted thereby permitting only a low overpressure in the crankcase.

A crankcase requires ventilation to atmospheric pressure. However, for environmental reasons, the simplest and cheapest solution - ventilating the crankcase directly to the surrounding atmosphere—is not acceptable. Instead, blow-by must be returned to the engine combustion chambers, which can be accomplished by mixing them with intake air in the intake manifold. The simplest solution for mixing the gases is to connect the evacuation channel from the crankcase to the intake manifold at a point before the charging unit, since there is substantially atmospheric pressure from the air intake filter to the charging unit. Still, even when using some form of oil separator, a certain amount of missed oil accompanies blow-by out of the crankcase and into the charging system. This oil is collected in the charging system and, depending on the amount of oil and the temperature, can disturb the charging system functioning.

Oil collecting in the charging system can be avoided by connecting the evacuation channel after the throttle. However, when connected there, especially at low loads, a pronounced sub-atmospheric pressure occurs that is undesirable for several reasons. Also, crankcase gases cannot be evacuated to this location when the engine is supercharged. This can be solved by creating two evacuation channels, one before the charging unit and one after the throttle. The evacuation channel after the throttle is connected to the intake manifold via a constriction and non-return valve, thereby preventing flow in the direction away from the intake manifold. However, it is difficult to achieve balance in such a system both for suction engines, which always have sub-atmospheric pressure in the intake manifold, and supercharged engines, which have sub-atmospheric pressure in the intake manifold at low loads and overpressure at high loads.

In one crankcase ventilation system for supercharged engines, the evacuation channel to the intake manifold before the charging unit contains a pressure regulator for maintaining an essentially constant pressure corresponding approximately to atmospheric pressure in the crankcase. At high loads, gas flows through this evacuation channel to the intake manifold on the suction side of the turbo unit. Since there is overpressure in the intake manifold downstream of the throttle, the non-return valve in the other evacuation channel is closed so that no air can be forced back into the crankcase. At low load and sub-atmospheric pressure in the intake manifold downstream of the throttle, blow-by flows from the crankcase via the non-return valve and the constriction to the intake manifold. At the same time under certain operating conditions, air is pulled via the pressure regulator from the intake manifold upstream of the charging unit to the intake manifold downstream of the throttle. This exchange between hot gas flowing in one direction and cold air flowing in the other direction causes condensation, with the risk of frost blockage in cold weather. To avoid this problem, a heating coil with hot coolant therein can be placed around the evacuation channel upstream of the throttle. However, such an installation is expensive.

Accordingly, there is a need for a cost-effective way of ventilating a crankcase without venting blow-by to atmosphere. Further, there is a need for ventilating a crankcase incorporating blow-by into the crankcase without collecting oil in the crankcase. There is also a need for incorporating blow-by into the crankcase without causing condensation.

SUMMARY OF THE INVENTION

The present invention provides a supercharged internal combustion engine with pressure-regulated crankcase ventilation whereby the above described disadvantages are removed. This is achieved according to the invention in an internal combustion engine having a cylinder block, a cylinder head, a crankcase containing oil, and an air intake channel in communication with intake channels in the cylinder head. The engine further has a separator for separating oil out of evacuated blow-by gas.

The air intake channel is connected to a compressor or charge unit, and has a throttle downstream of the charge unit. The air intake channel has at least two evacuation channels and at least two pressure regulators. A first evacuation channel joins the crankcase to the air intake channel at a point downstream of the throttle for evacuating blow-by gases from the crankcase. This first evacuation channel communicates with a first pressure regulator arranged to maintain an substantially constant pressure in the crankcase. A second evacuation channel connects the crankcase to the air intake channel at a point on the suction side of the charge unit. This second evacuation channel communicates with a second pressure regulator arranged to maintain at least an approximately constant pressure in the crankcase. Both evacuation channels are coordinated with a valve or valve means that is disposed to limit or prevent gas flow in the direction from the intake channel towards the crankcase.

By virtue of the invention there is achieved a pressure-regulated crankcase ventilation both for suction engine operation, i.e., for low load operation, and for supercharging, i.e., for high load operation. During suction engine or low load operation, substantially all of the crankcase gas flows through the first evacuation channel to the intake manifold downstream of the throttle. This is due to the valve means in the second evacuation channel preventing or limiting the flow of fresh air in the opposite direction, i.e., to the crankcase. When the intake manifold is charged with overpressure, then substantially all the crankcase gas goes through the second evacuation channel to the intake manifold on the suction side of the charge unit. This is due to the valve or valve means in the first evacuation channel preventing or limiting the flow from the intake manifold to the crankcase.

The valve or valve means in the evacuation channels can be either simple check valves that completely block flow to the crankcase, or valves that prevent a high flow in the direction from the crankcase and a limited flow, or calibrated leakage, in the opposite direction. The advantage of the latter solution is that the risk of creating unacceptably low pressure in the crankcase when engine braking is eliminated. Since in this case there is no combustion producing blow-by gases, and the sub-atmospheric pressure in the intake manifold after the throttle is at a maximum when the throttle is closed, the sub-atmospheric pressure will otherwise cause gas to flow in the opposite direction, i.e., from the crankcase past the piston rings into the combustion chamber and out through the exhaust manifold. Under less favorable conditions, this reversed gas flow could lead to the crankcase pressure being so low that air would be sucked via the crankshaft seals into the crankcase from the surrounding atmosphere since the sealing lips of the seals are turned to seal against overpressure in the crankcase and not against overpressure on its outside. This can result in sucking in contaminants, causing damage to bearings, pistons and cylinder linings.

By the flowing of air from the surrounding atmosphere to the crankcase at a calibrated leakage through the valves allows selection of a pressure in the intake manifold which is so low that the engine does not produce any natural blow-by gas. Natural blow-by gas occurs when the average pressure above the piston is lower than the average pressure below the piston. This situation can occur during engine braking in combination with extremely low intake pressure. Despite the fact that the engine does not produce any blow-by gas by itself, the pressure regulators can regulate the crankcase pressure from the blow-by amount of air via the evacuation channels.

With airflow into the crankcase via the evacuation channels, a higher total flow is obtained through the oil separator, producing more complete oil separation. Furthermore, the increased blow-by gas velocity produces a higher heating effect in the gas, thereby improving the cold properties of the oil separator, pressure regulators and associated hoses and pipes.

BRIEF DESCRIPTION OF THE DRAWINGS

The invention will be described in more detail below with reference to examples shown in the accompanying drawings, where.

DETAILED DESCRIPTION

Figure 1:
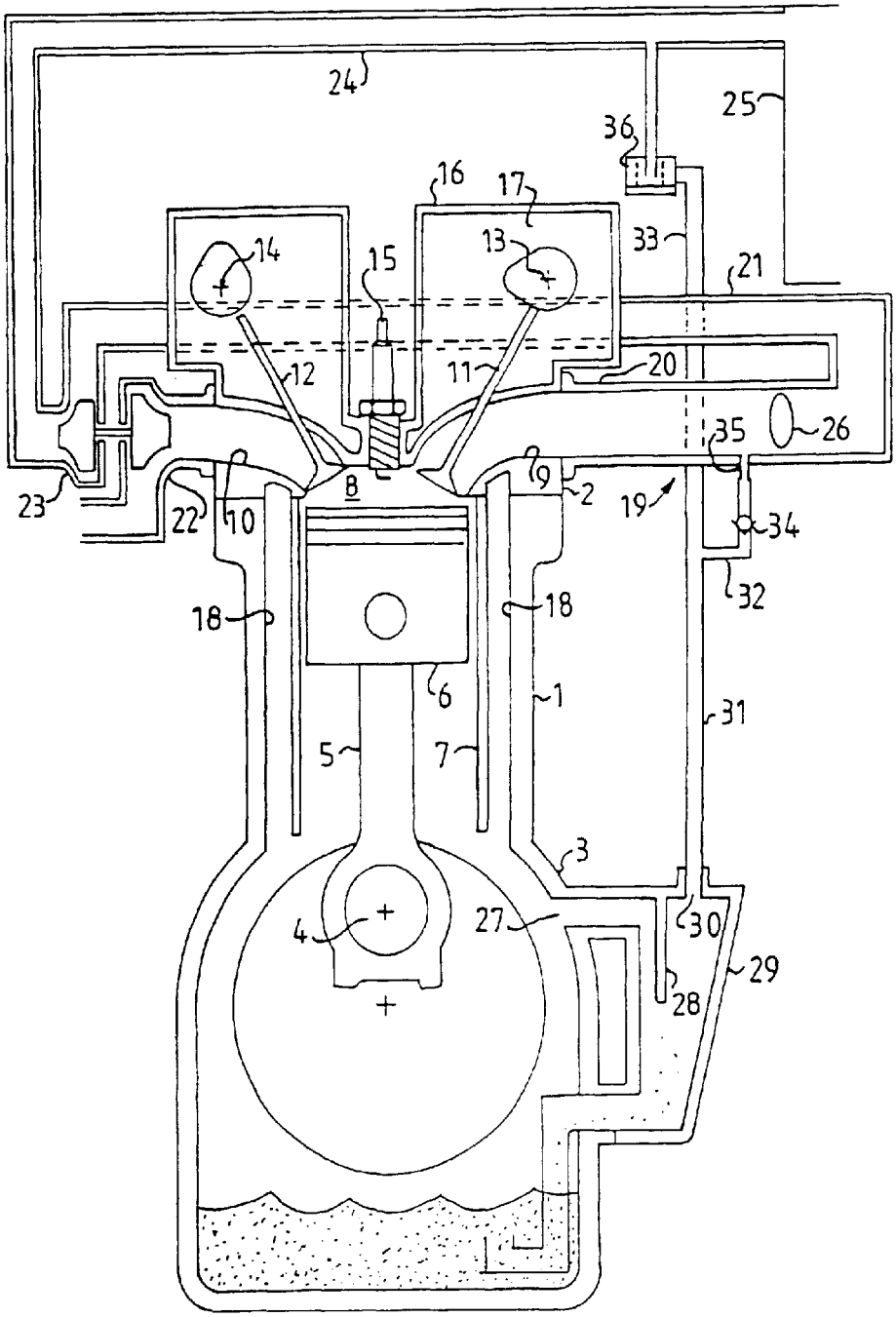
FIG.1 PRIOR ART
FIG. 1 illustrates a schematic cross-section of a turbo-charged internal combustion engine with a previously known crankcase ventilation system.

The Figures illustrate a cross section through one cylinder of a multi-cylinder, e.g., four or six cylinders, straight engine with a cylinder block 1, a cylinder head 2 and a crankcase 3 containing lubricant. A crankshaft 4 mounted in the crankcase is joined via connecting rods 5 to pistons 6 in cylinder 7. In the cylinder head 2 there is combustion chambers 8, into which intake channels 9 and exhaust channels 10 open.

The gas exchange in the combustion chambers 8 is controlled by intake and exhaust valves 11 and 12, respectively, which are driven by camshafts 13 and 14, respectively. A sparkplug 15 projects into each combustion chamber 8. Valves and camshafts are enclosed in a space defined by the cylinder head 2 and a valve cover 16, with the space 17 communicating with the crankcase 3 via channels 18 in the cylinder head 2 and the cylinder block 1.

An intake manifold 19 is screwed securely to the cylinder head 2 and has branch channels 20 opening into intake channels 9 in the cylinder head. The manifold 19 is connected via a channel 21 with a charge air cooler (not shown) to an outlet from a compressor 23 driven by an exhaust turbine 22, the inlet to the compressor 23 being connected to an intake air channel 24 with an air filter 25. The supply of air to the combustion chambers 8 is regulated by a throttle 26. The interior of the crankcase 3 communicates with a container 29 provided with baffles 28 via an opening 27. The container 29 forms an oil separator for separating and returning the oil in the oil mist that unavoidably follows the blow-by gas out through the opening 27 in the crankcase. The oil separator 29 can be of any type commonly known, mounted in a plastic container fixed to the outside of the crankcase.

In the engine shown in FIG. 1, the oil separator has an outlet 30 connected to a channel 31 that splits into two branches 32 and 33. One branch 32 is connected to the intake manifold 19 downstream of the throttle 26. The other branch 33 is connected to the air intake channel 24 between the air filter 25 and compressor 23. One branch 32 communicates with the intake channel 20 via a non-return valve 34 and constriction 35, while the other branch 33 communicates with the intake air channel 24 via a pressure regulator 36 disposed to maintain a substantially constant pressure slightly below atmospheric pressure in the crankcase. The engine at low load works as a suction engine, with sub-atmospheric pressure in the intake manifold 19 downstream of the throttle 26. Blow-by gas flows primarily through the manifold branch 32, which means that not any or very little oil will be collected upstream of the throttle 26. The engine at high load is supercharged so that overpressure prevails in the intake manifold 19 downstream of the throttle 26. This results in the non-return valve 34 closing, resulting in blow-by gas flowing through the regulator branch 33 to the intake air channel 24. However, since the air velocity is high, the oil mist is drawn with the intake air into the combustion chamber without depositing oil in the charging system.

As mentioned above, under certain operating conditions, air intake can be pulled from the air intake channel 24, through the regulator branch 33 and its pressure regulator 36 to the intake channel downstream of the throttle 26. This alternating flow of warm blow-by gas and cold intake air in the branch 33 increases the risk of freezing in cold weather, necessitating some way of heating the branch 33. The constriction 35 must also be serviced regularly to prevent clogging.

Figure 2:
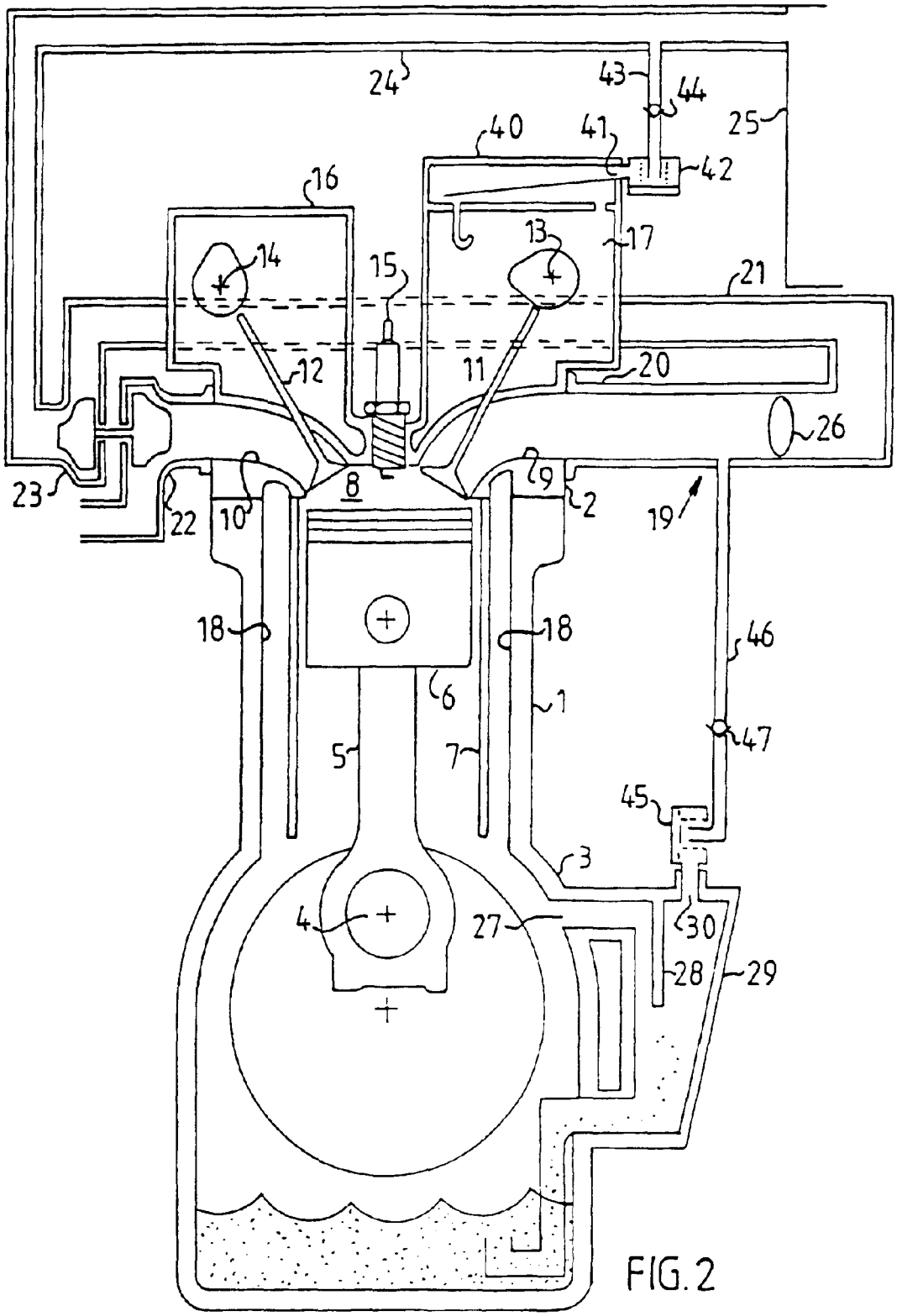
FIG. 2 illustrates a schematic cross-section of one embodiment of a turbo-charged internal combustion engine with a crankcase ventilation system according to the present invention.

FIG. 2 illustrates a simple and inexpensive embodiment according to the invention that avoids the above mentioned problems. In addition to the oil separator 29 that communicates directly with the crankcase 3, there is an additional oil separator 40 that is joined to the valve cover 16 and communicates with the space 17 and, thus, also with the crankcase 3 via the channels 18 in the cylinder head 2 and the block 1. The outlet 41 of the oil separator 40 opens directly into a pressure regulator 42, which is disposed to maintain a substantially constant pressure slightly below atmospheric pressure in the space 17 and, thus, in the crankcase 3 as well. The pressure regulator 42 communicates with the air intake channel 24 at a point between the air filter 25 and the compressor or charge unit 23 via a channel 43 containing a non-return valve 44. This non-return valve 44 permits free flow of crankcase gas in the direction towards the intake channel 24. The non-return valve 44 can be of a conventional type that blocks flow completely in one direction, or of a type that permits free flow in one direction and a limited flow in the opposite direction. In the present case, the latter type is preferred since when there is a negative blow-by flow, i.e., flow from the crankcase 3 to the combustion chamber, which can occur, for example, during heavy engine braking, it permits a limited flow of fresh air to the crankcase 3. The outlet 30 to the oil separator 29 that communicates directly with the crankcase 3, is connected to a pressure regulator 45, which, like the other pressure regulator 42 maintains substantially constant pressure slightly below atmospheric pressure in the crankcase 3. A channel 46 joins the pressure regulator 45 to the intake channel 20 downstream of the throttle 26 and contains a non-return valve 47, which can be of the same type as the non-return valve 44, i.e., a valve which permits free crankcase gas flow from the crankcase but prevents or limits flow in the opposite direction.

At low load when the compressor 23 does not supercharge, there is sub-atmospheric pressure in the intake channel 20 downstream of the throttle 26. Blow-by gas now flows via the oil separator 29, the pressure regulator 45 and the channel 46 to the intake channel 20. It should be noted that the channel 46 lacks a constriction corresponding to the constriction 35 in the previously known system shown in FIG. 1, thereby reducing the number of locations in the engine requiring regular service.

At high load when the compressor 23 supercharges, overpressure prevails in the intake channel 20, and blow-by gas now flows via the channels 18, the chamber 17, the oil separator 40, the pressure regulator 42 and the channel 43 to the air intake channel 24. If the valve 47 is a pure non-return valve, there will be no airflow to the crankcase 3 via the channel 46. However, the valve 47 is preferably a valve that that permits a limited calibrated airflow from the intake channel 20 to the crankcase 3. This increases the gas velocity through the oil separator 40, improving oil separation and increasing the temperature in the pipes and hoses. This is particularly advantageous in a straight engine with a hot and cold side, with the cold side at the front of the vehicle. By utilizing at least two oil separators 29 and 40 and placing the second oil separator 40 so that it is connected to the valve cover 16, optimally short channels are achieved, further reducing the risk of freezing.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

What is claimed is:

1. A supercharged internal combustion engine including a cylinder block, a cylinder head, a crankcase containing oil, the engine comprising:

an air intake channel communicating with one or more intake channels in the cylinder head, the air intake channel being connected to a charge unit and having a throttle downstream of the charge unit, a first evacuation channel joining the crankcase to the intake air channel at a point downstream of the throttle for evacuation of blow-by gases from the crankcase, a second evacuation channel connecting the crankcase to the air intake channel at a point on the suction side of the charge unit and communicating with a first pressure regulator arranged to maintain an at least approximately constant pressure in the crankcase, and one or more oil separators for separating oil out of evacuated blow-by gas, wherein the first evacuation channel communicates with a second pressure regulator arranged to maintain said essentially constant pressure in the crankcase, and wherein both evacuation channels are coordinated with valves disposed to limit or prevent gas flow in the direction from the intake channel towards the crankcase.

2. The internal combustion engine according to claim 1 wherein the valves are non-return valves, thereby preventing flow in the direction from the intake channel towards the crankcase.

3. The internal combustion engine according to claim 1 wherein the valves are non-return valves, thereby permitting flow in the direction from the crankcase towards the intake channel and a limited flow in the opposite direction.

4. The internal combustion engine according to claim 1, the one or more oil separators for separating oil out of the evacuated blow-by gas further comprising first and second oil separators in communication with the first and the second evacuation channels.

5. The internal combustion engine according to claim 4 wherein the first evacuation channel is in communication with an oil separator in communication with the crankcase, and the second evacuation channel is in communication with an oil separator in communication with a space defined between the cylinder head and a valve cover, the space communicating with the crankcase.

6. A crankcase ventilation system for an internal combustion engine having a cylinder block, a cylinder head, a compressor, a throttle and a crankcase, the ventilation system comprising:

an air intake channel in communication with the cylinder head, at least one oil separator, a first evacuation channel for connecting the crankcase to the air intake channel downstream of the throttle, and a second evacuation channel for connecting the crankcase to the air intake channel upstream of the compressor, wherein both evacuation channels are further comprising a valve disposed for limiting or preventing gas flow in a direction from the air intake channel to the crankcase.

7. The ventilation system according to claim 6 further comprising a pressure regulator in communication with the first evacuation channel for maintaining substantially constant pressure in the crankcase.

8. The ventilation system according to claim 6 further comprising a pressure regulation communication with the second evacuation channel for maintaining substantially constant pressure in the crankcase.

9. The ventilation system according to claim 6, wherein the oil separator is in communication with the first evacuation channel for separating oil out of evacuated blow-by gas.

10. The ventilation system according to claim 6, wherein the oil separator is in communication with the second evacuation channel for separating oil out of evacuated blow-by gas.

11. The ventilation system according to claim 6, wherein the at least one oil separator is in communication further comprised of one oil separator in communication with the first evacuation channel for separating oil out of evacuated blow-by gas, and a second oil separator in communication with the second evacuation channel for separating oil out of evacuated blow-by gas.

12. The ventilation system according to claim 6 further comprising a pressure regulator in communication with the first evacuation channel for maintaining substantially constant pressure in the crankcase, and a second pressure regulator in communication with the second evacuation channel for maintaining substantially constant pressure in the crankcase.

* * * * *

UNITED STATES PATENT AND TRADEMARK OFFICE

CERTIFICATE OF CORRECTION

PATENT NO. : 6,405,721 B1
DATED : June 18, 2002
INVENTOR(S) : Moren, Mats

It is certified that error appears in the above-identified patent and that said Letters Patent is hereby corrected as shown below:

Title page,
Item [73], the Assignee should read -- Volvo Car Corporation (SE) --.

Signed and Sealed this

Twenty-eighth Day of January, 2003

JAMES E. ROGAN
*Director of the United States Patent and Trademark Office*